United States Patent [19]

Russell

[11] Patent Number: 4,549,410

[45] Date of Patent: Oct. 29, 1985

[54] INSULATOR FOR BOTTLED BEVERAGES

[76] Inventor: William C. Russell, TDL P.O. Box 28, Denton, Tex. 76201

[21] Appl. No.: 684,951

[22] Filed: Dec. 21, 1984

[51] Int. Cl.[4] ..... F25D 3/08

[52] U.S. Cl. ..... 62/457; 215/13 R

[58] Field of Search ..... 215/13 R; 62/457, 529, 62/530, 371, 372

[56] References Cited

U.S. PATENT DOCUMENTS

| | | | |
|---|---|---|---|
| 2,522,381 | 9/1950 | Kramer | 215/13 R |
| 2,759,617 | 8/1956 | Gauthier | 215/13 R |
| 3,120,319 | 2/1964 | Buddrus | 215/13 R |
| 3,365,911 | 1/1968 | Stoner et al. | 62/457 |
| 3,603,106 | 9/1971 | Ryes | 62/457 |
| 4,163,374 | 8/1979 | Moore et al. | 62/457 |
| 4,183,226 | 1/1980 | Moore | 62/457 |
| 4,197,890 | 4/1980 | Simko | 62/372 X |
| 4,255,944 | 3/1981 | Gardner et al. | 62/457 |
| 4,281,520 | 8/1981 | Norwood | 62/372 |
| 4,338,795 | 7/1982 | House, Jr. | 62/457 X |
| 4,344,303 | 8/1982 | Kelly, Jr. | 62/530 |
| 4,380,157 | 4/1983 | Christiani | 62/315 |
| 4,388,813 | 6/1983 | Gardner et al. | 62/457 |
| 4,393,665 | 7/1983 | Gardner et al. | 62/457 |
| 4,401,245 | 8/1983 | Zills | 215/13 R |

*Primary Examiner*—Lloyd L. King

*Attorney, Agent, or Firm*—Robert E. Wagner; Alan L. Barry

[57] ABSTRACT

A unique, refrigerant-free, insulator for maintaining the temperature of beverages contained in neck ring containers, such as bottles, comprising a unitary outer shell with a bottom opening for receiving the container and a top opening for receiving the container neck ring, an insulating sleeve carried within the shell and a retaining ring surrounding the bottom shell opening for supporting the bottom of the container.

5 Claims, 3 Drawing Figures

FIG. 1
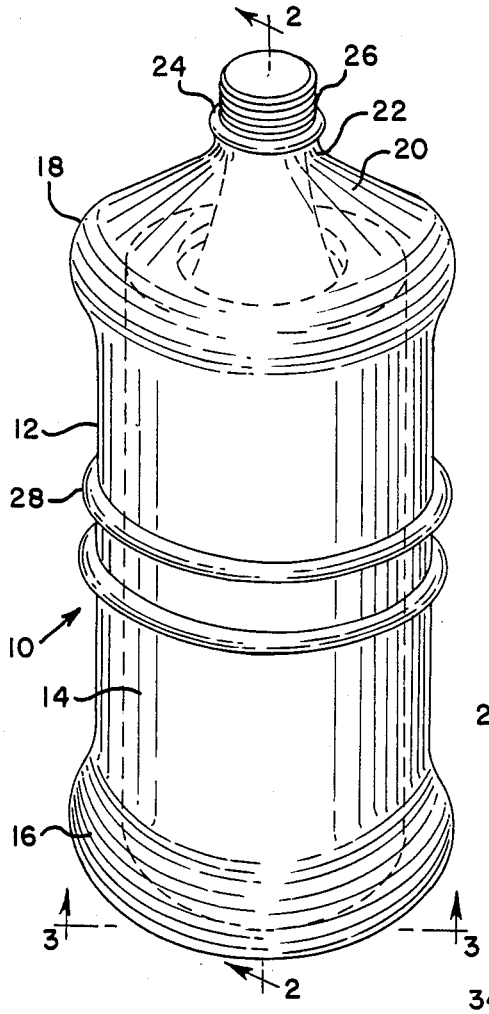
FIG. 2
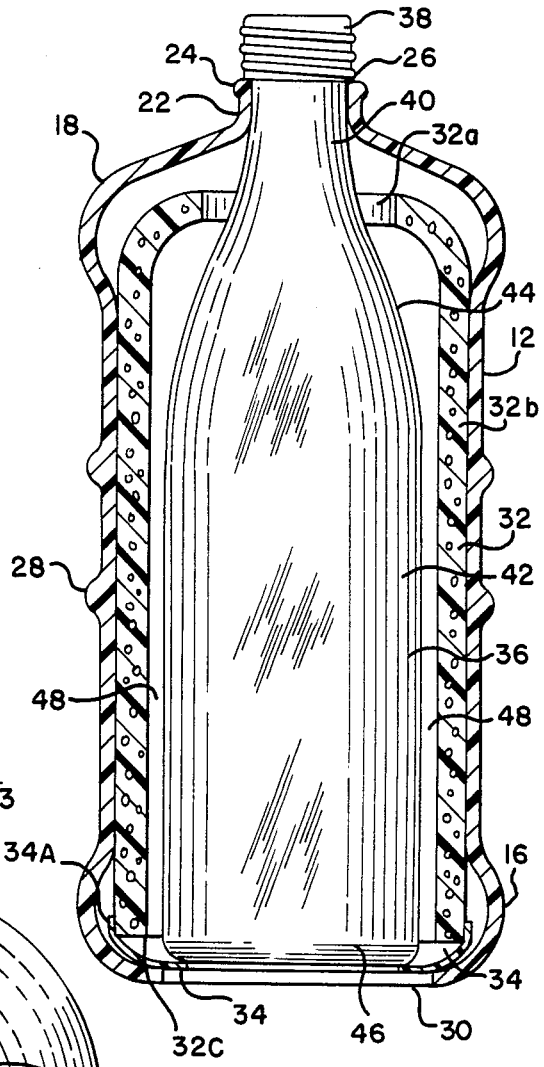
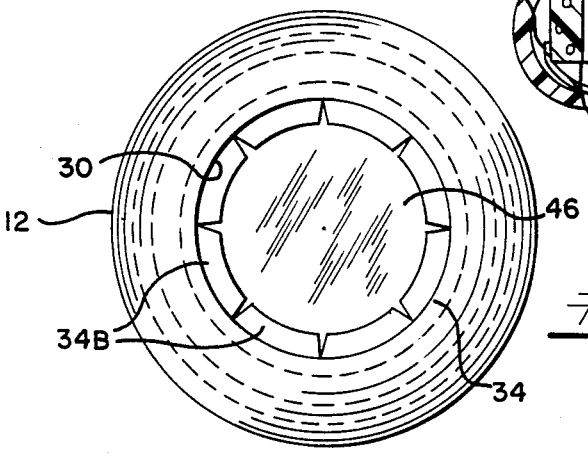
FIG. 3

INSULATOR FOR BOTTLED BEVERAGES

DESCRIPTION

Technical Field

The present invention generally relates to insulating and cooling jackets and devices for fluid containers and in particular to an easily handled insulator for bottled beverages which permits direct consumption of the beverage from the bottle.

BACKGROUND OF THE INVENTION

With the improvement in the design, construction and manufacture of glass and plastic beverage bottles and particularly the advent of replaceable bottle caps, many consumers frequently drink such beverages directly from the bottles. As a result, such bottles not only function as a means of packaging the beverage product, but are also now used as a server for direct consumption of the beverage.

As a result, within the last several years, several devices have been developed which attempt to provide improved insulating properties to the otherwise poor insulating capabilities of glass and plastic beverage bottles. Included among these devices is a flexible insulating jacket in which the beverage bottle is carried as disclosed in U.S. Pat. No. 4,197,890 and a pair of mating hollow modules in which is carried refrigerant material, the modules being fastened together to surround the body of a bottle as disclosed in U.S. Pat. No. 4,281,520. Further, U.S. Pat. No. 4,338,795 discloses an insulating and cooling receptacle into which a beverage bottle is inserted having an upper hollow collar containing permanent refrigerant such as "Blue Ice" which surrounds the shoulders and a portion of the neck of the bottle.

However, such prior art bottle insulating devices are comprised of a multiplicity of parts which attempt to surround the outward surface area of the bottle. Also, as described above, many prior art devices require either activation of permanent refrigerant materials contained within the construction of the insulator body by precooling of the insulator or the addition of refrigerant materials, such as ice, to the insulator.

In addition, many of the prior art insulators do not permit direct consumption of the beverage from the bottle enclosed within the insulator. Hence, the bottle must be removed from the insulator thereby disturbing the insulating conditions which existed within the insulator.

Moreover, none of the prior art insulating devices take advantage of the outward configuration of a beverage bottle as an efficient and useful means of holding the bottle within the insulating device. Specifically, soft drink and light-alcohol content beverage bottles include a neck ring which carries multiple threads or a single thread depending on whether the cap is a replaceable, screw-on cap or a non-replaceable, crown cap. As a result of the presence of the neck ring on the bottle, the bottle itself can be carried or held by gripping the bottle about the neck ring. None of the beverage bottle insulating devices of the prior art have been constructed so as to suspend the beverage bottle within the insulator by gripping of the bottle about or adjacent to the bottle neck ring.

Hence, prior to the present invention, a need existed for a refrigerant-free beverage bottle insulator which can be hand-held in order to permit direct consumption of the beverage from the bottle held within the insulator. Further, a need existed for a beverage bottle insulator designed to permit easy insertion and removal of the beverage bottle through a bottle insulator design which takes advantage of the configurational characteristics of most beverage bottles.

SUMMARY OF THE INVENTION

According to the present invention, a unique and simplified insulator for common beverage bottles has been developed which efficiently maintains the bottle and its beverage contents at approximately their initial temperatures for extended periods of time. Further, the insulator of the present invention is both refrigerant-free and because of its resilient unitary construction, imparts a degree of impact resistance to the bottle held within the insulator. Finally, the novel design of the present insulator utilizes the neck ring of common beverage bottles to efficiently hold standard shaped bottles within the insulator, thereby permitting easy removal and insertion of the bottle.

Generally, the preferred embodiment of the present invention includes a resilient unitary construction comprised of an outer shell preferably made from polyvinylchloride or polyethylene plastic. The shell has a top opening with inner dimensions smaller than the neck ring of common beverage bottles. Because of the flexibility of the materials from which the shell is made, the top opening is expansible thereby permitting the passage of the neck ring through the opening. After passage of the neck ring the opening returns to its original dimensions to grip the bottle directly under the neck ring. The shell further includes a bottom opening having inner dimensions generally larger than the outer dimensions of common beverage bottles.

In addition to the outer, one-piece shell, a one-piece, inner insulating sleeve is preferably adhered to the inner side walls of the shell. The sleeve is preferably made from an insulating plastic foam such as polystyrene. Finally, a retaining device preferably an annular ring comprised of a plurality of flexibly connected tabs or flaps is inserted inside of the shell between the lower terminal end of the insulating sleeve and the floor of the shell. The inner peripheral edges of the tabs define an opening having an inner dimension smaller than the inner dimension of the bottom shell opening and the bottom opening of the insulating sleeve. The purpose of the retaining ring is to provide further support to the bottom of the bottle and to minimize movement of the bottle within the insulator.

The present invention will be more completely described in the following detailed description of preferred embodiment and the claims appended thereto.

BRIEF DESCRIPTION OF THE DRAWINGS

FIG. 1 is a perspective view of the preferred embodiment of the insulator of the present invention;

FIG. 2 is a vertical section of the preferred embodiment of the present invention taken along line 2—2 of FIG. 1, and;

FIG. 3 is a bottom side view of the preferred embodiment of the present invention taken along line 3—3 of FIG. 1.

DETAILED DESCRIPTION OF PREFERRED EMBODIMENT

Referring now to the drawings, FIG. 1 discloses a preferred embodiment of the beverage bottle insulator of the present invention generally referenced by 10. Insulator 10 is generally barrel-shaped to accommodate the rounded shape of the common beverage bottles, although it should be understood that the overall configuration can be modified in accordance with beverage container shape. Insulator 10 is comprised of a one-piece outer shell 12 having arcuate outer walls 14 flaring outward at the bottom to define a base portion 16. Base portion 16 provides both better stability to insulator 10 particularly when a beverage bottle is full of fluid and enhances handling. The upper portions of side walls 14 outwardly flare to form a shoulder portion 18 and thereafter inwardly slope to a top portion 20 of shell 12. Top portion 20 also upwardly slopes to define a preferably tubular neck 22 which terminates in an annular lip 24 which encircles a top opening 26 of shell 12. In the preferred embodiment of insulator 10, shell 12 also includes a plurality of raised ribs 28 about the circumference of shell 12. Ribs 28 can be used for gripping and handling insulator 10 particularly when it carries a bottle full of beverage or condensation on shell 12 makes handling difficult.

Preferably, shell 12 is made by blow molding polyvinylchloride or polyethylene. As seen in FIG. 2, top opening 26 has inner dimensions no more than and preferably less than the outer dimensions of the neck of common beverage bottles. Shell 12 also has a bottom opening 30 having inner dimensions at least as large as the outer dimensions of beverage bottles. Hence, shell 12 may be manufactured by either a blow molded container with openings 26 and 30 being cut after the blow molding process or as an extruded sleeve with openings 26 and 30 already formed in the die.

As disclosed in FIG. 2, an open ended sleeve 32 is carried within the interior of shell 12. Insulating sleeve 32 may be manufactured from one of several insulating foams such as semi-rigid polystyrene foam marketed under the Styrofoam trademark. Sleeve 32 has a top opening **32*a* which is preferably positioned within the shoulder portion 18 of shell 12. Top opening 32*a* is formed by the arcuate turning-in of the side walls 32*b* comprising of sleeve 32. The side walls 32*b* extend downwardly to define a bottom opening 32*c*. In order to maintain the positioning of sleeve 32 within shell 12, side walls 32*b* are adhered to the inner faces of side walls 14 of shell 12** by any plastics adhesive known in the art.

As further disclosed in FIG. 2 and also FIG. 3, a retaining ring 34 surrounds the periphery and partially extends into bottom shell opening 30. As disclosed in FIG. 2, a lowermost terminal portion of side wall **32*b* of sleeve 32 stops short and does not extend to the floor of shell 12. Rather, the terminal portions of side walls 32*b* seat into ring 34 and against an upwardly turned portion 34*a* of ring 34**.

As best disclosed in FIG. 3, retaining ring 34 is preferably comprised of a plurality of flexibly joined flaps **34*b*. Preferably, ring 34 should be made from a resilient, semi-rigid plastic permitting ready deflection of flaps 34*b* but permitting them to return rapidly to a normal operative position. Flaps 34*b* extend inwardly into bottom shell opening 30 thereby decreasing its overall inner dimensions. Ring 34 and particularly flaps 34*b* function to provide support to peripherial edge portions of the bottom of the beverage bottle. The support and retention function of ring 34** will be discussed later in greater detail.

Again referring to FIG. 2, a common beverage container or bottle 36 is typically comprised of a neck ring 38, carrying threads for a replaceable screw-on cap. A neck 40 is joined to the body 42 by sloping shoulders 44. Body 42 terminates at a base or bottom 46. Insulator 10 of present invention functions by the first insertion of neck ring 38 into bottom opening 30 of shell 12. As bottle 36 passes through bottom shell opening 30 flaps **34*b* of containing ring 34 flexibly deflect upward or to the side to permit passage of the much larger shoulder 44 and body 42 of the bottle 36. As bottle 36 approaches shoulder portion 18 of shell 12, the neck ring 38 must be seated in opening 26 and forced through opening 26 so as to expand opening 26 to permit passage of the larger sized neck ring 38. After receiving neck ring 38, opening 26 rapidly returns to its original inner dimensions because of the resiliency of shell 12. As a result, annular lip 24 tightly seats underneath neck ring 38 thereby substantially suspending bottle 36 within insulating sleeve 32 and shell 12. Also the bottle is held to some extent by somewhat of an interference-fit between bottle neck 40 and the inner surfaces of shell neck 22. Because of this unique suspension of bottle 36 by neck ring 38, neither the body 42 or shoulder 44 of bottle 36 directly contact side walls 32*b* of insulating sleeve 32. As result, a narrow insulating air space 48 is created between body 42, shoulder 44 and side walls 32*b*. Air space 48 provides additional insulating properties to insulator 10 in addition to those imparted by insulating sleeve 32 and to some extent shell 12**.

In addition to suspending bottle 36 within insulator 10 by engagement of neck ring 38 on annular lip 24, it is also necessary to further support bottle 36 within insulator 10 and to provide a means for restraining movement of bottle 36 within sleeve 32. Such restraint and support is accomplished through use of ring 34. In order for flaps **34*b* of ring 34 to return to their original extended positions, the user may find it necessary to force bottle 36 further upward through shell neck 22. Further movement of bottle 36 upward through neck 22 is permitted to some degree as a result of shell shoulders 18 which provide flexibility to top portion 20 of shell 12. Once flaps 34*b* of ring 34 return to their original extended positions, then bottle 36 may rest on such flaps 34. Further, flaps 34*b* restrain movement of bottle 36 within sleeve 32 thereby maintaining the air space 48**.

Unlike prior art bottle insulating devices utilizing refrigerants, the present invention can maintain the temperature of the fluid within a beverage bottle by usage of essentially three insulating layers, namely an insulating air space, an insulating foam sleeve and, to some extent, the insulating properties imparted by the flexible plastic outer shell. In addition, unlike the prior art beverage bottle insulating devices, because the outer shell of the present invention is manufactured from a flexible plastic such as polyvinylchloride or polyethylene, the insulator of the present invention provides some impact resistance to the beverage bottle held within the insulator.

Also, because the insulator of the present invention carries a beverage bottle by suspending it from the neck ring, the present invention can be used to hold bottles of varying heights. With shorter bottles, it is likely that retaining ring will not come in contact with the bottom of the bottle. However, it is believed that with shorter beverage bottles, the degree of movement of the bottle within the insulator is far less than with longer bottles. Therefore the non-functioning of the retaining ring in these instances does not appreciably affect insulating performance of the device.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope therof. Therefore, it is intended that the invention not be limited to a particular embodiment disclosed as the best mode contemplated for carrying out the invention, but that the invention will include all embodiments falling within the scope of the appended claims.

I claim:

1. A refrigerant-free insulator and holder for beverages carried in containers having a neck ring comprising:

(a) a semi-rigid outer shell, the shell having a top opening to receive the container neck ring, the top opening having inner dimensions slightly smaller than the outer dimensions of the neck ring, the shell also having a bottom opening to receive the container, the bottom opening having inner dimensions slightly larger than the outer dimensions of the container body;

(b) an inner insulating sleeve carried within the shell; and, (c) means for supporting the bottom periphery of the container, the support means being carried within the shell and surrounding the bottom opening of the shell, the support means flexing to a position permitting insertion and removal of the container from within the shell and thereafter returning to a support position, such that when a container is admitted into the shell through the bottom opening the neck ring of the container causes the top opening to expand to permit passage of the neck ring, thereafter the top opening contracts underneath the neck ring, the contracted top opening and support means in the support position holding the container within the shell.

2. The insulator of claim 1 wherein the side walls of the upper portion of the sleeve arc inwardly to define a top sleeve opening, the top sleeve opening having a smaller dimension than the bottom sleeve opening.

3. The insulator of claim 1 wherein the support means includes a flexible ring, the ring having a plurality of flexibly joined flaps, the flaps being inwardly directed to define an opening having inner dimensions smaller than the outer dimensions of the container body.

4. The insulator of claim 1 further including an outwardly disposed lip surrounding the top opening, the lip seating underneath the neck ring upon the contraction of the top opening of the shell.

5. A refrigerant-free insulator and holder for beverages carried in containers having a neck ring comprising:

(a) a semi-rigid outer shell, the shell having a top opening to receive the container neck ring, the top opening having inner dimensions slightly smaller than the outer dimensions of the neck ring, the shell also having a bottom opening to receive the container, the bottom opening having inner dimensions slightly larger than the outer dimensions of the container body;

(b) an inner insulating sleeve carried within the shell; and, (c) a flexible ring for supporting the bottom periphery of the container body, the ring surrounding the bottom opening of the shell, the ring including a plurality of flexibly joined flaps, the flaps being inwardly directed to define an opening, the opening having inner dimensions smaller than the outer dimensions of the container body;

such that when the container is admitted into the shell through the bottom opening the neck ring of the container causes the top opening to expand to permit passage of the neck ring, thereafter the top opening contracts underneath the neck ring, the contracted top opening and support means in the support position holding the container within the shell.

* * * * *